US008157414B2

(12) United States Patent
Schaefer et al.

(10) Patent No.: US 8,157,414 B2
(45) Date of Patent: Apr. 17, 2012

(54) LED OPTICAL ASSEMBLY

(75) Inventors: Gary Eugene Schaefer, Kitchener (CA); Hristea Mihalcea, Kitchener (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 353 days.

(21) Appl. No.: 12/363,281

(22) Filed: Jan. 30, 2009

(65) Prior Publication Data

US 2010/0195323 A1 Aug. 5, 2010

(51) Int. Cl.
*F21V 5/00* (2006.01)
*F21V 7/04* (2006.01)

(52) U.S. Cl. ..... 362/245; 362/244; 362/247; 362/297; 362/308

(58) Field of Classification Search ..... 362/235, 362/237, 238, 240, 241, 243–247, 249.02, 362/297, 304, 305, 308, 309, 311.02, 328, 339

See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 4,788,633 | A * | 11/1988 | Zimermann et al. | 362/296.08 |
| 7,497,601 | B2 * | 3/2009 | Uke | 362/350 |
| 7,766,509 | B1 * | 8/2010 | Laporte | 362/249.02 |
| 2003/0156410 | A1 * | 8/2003 | Ter-Hovhannisian | 362/241 |
| 2009/0310359 | A1 * | 12/2009 | Hsiao et al. | 362/241 |

* cited by examiner

*Primary Examiner* — Bao Q Truong
(74) *Attorney, Agent, or Firm* — Mark L. Beloborodov

(57) ABSTRACT

An LED optical assembly is provided having a support surface having a plurality of light emitting diodes, a plurality of reflectors, and a plurality of optical lenses. Each reflector is positioned over a corresponding light emitting diode and at least one optical lens is placed over a corresponding reflector.

27 Claims, 20 Drawing Sheets

LED OPTICAL ASSEMBLY

CROSS-REFERENCE TO RELATED DOCUMENTS

Not Applicable.

TECHNICAL FIELD

This invention pertains generally to an optical assembly, and more specifically to an LED optical assembly.

BRIEF DESCRIPTION OF THE ILLUSTRATIONS

DETAILED DESCRIPTION

Figure 1:
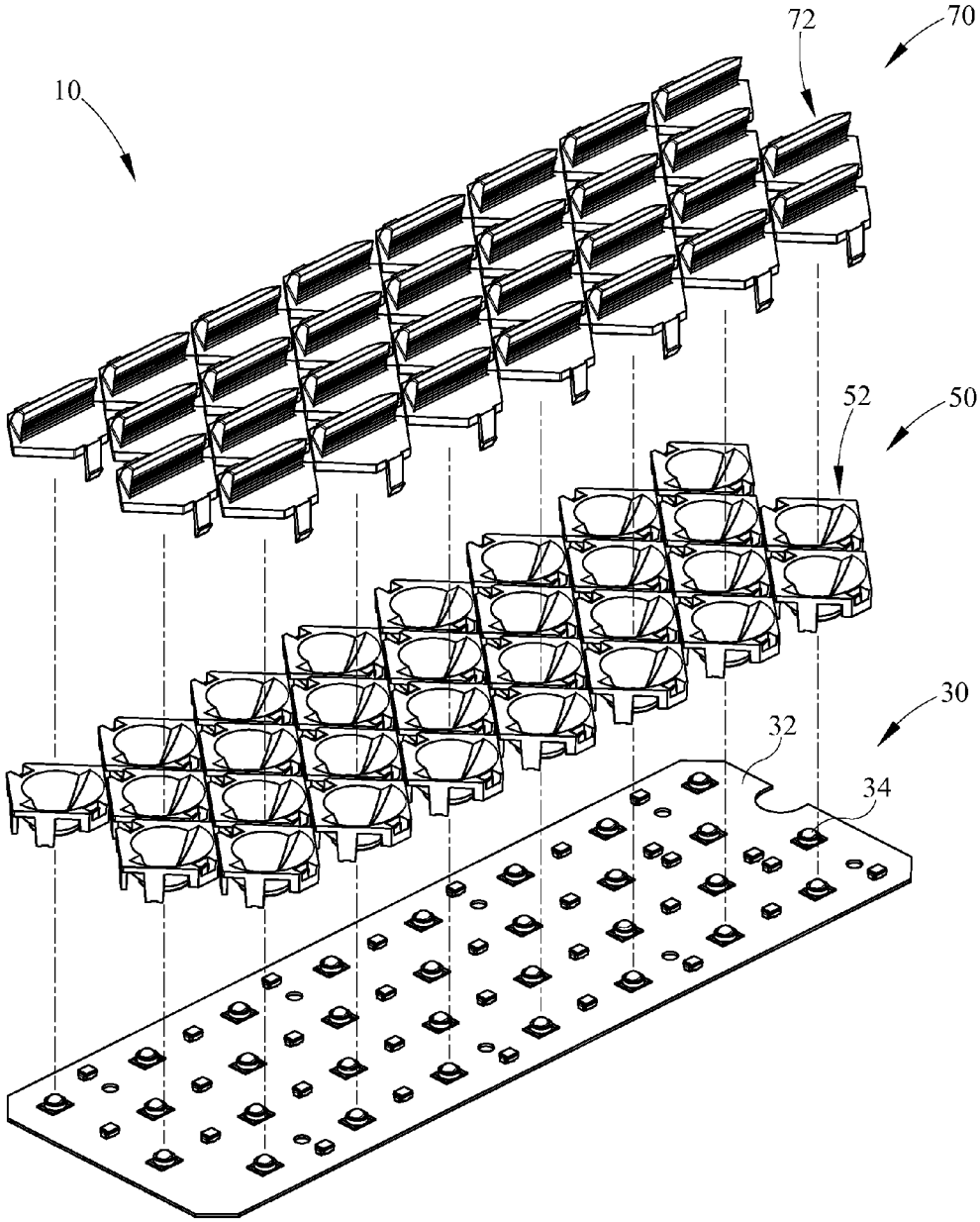
FIG. 1 is an exploded perspective view of a first embodiment of the LED optical assembly of the present invention.
Figure 2:
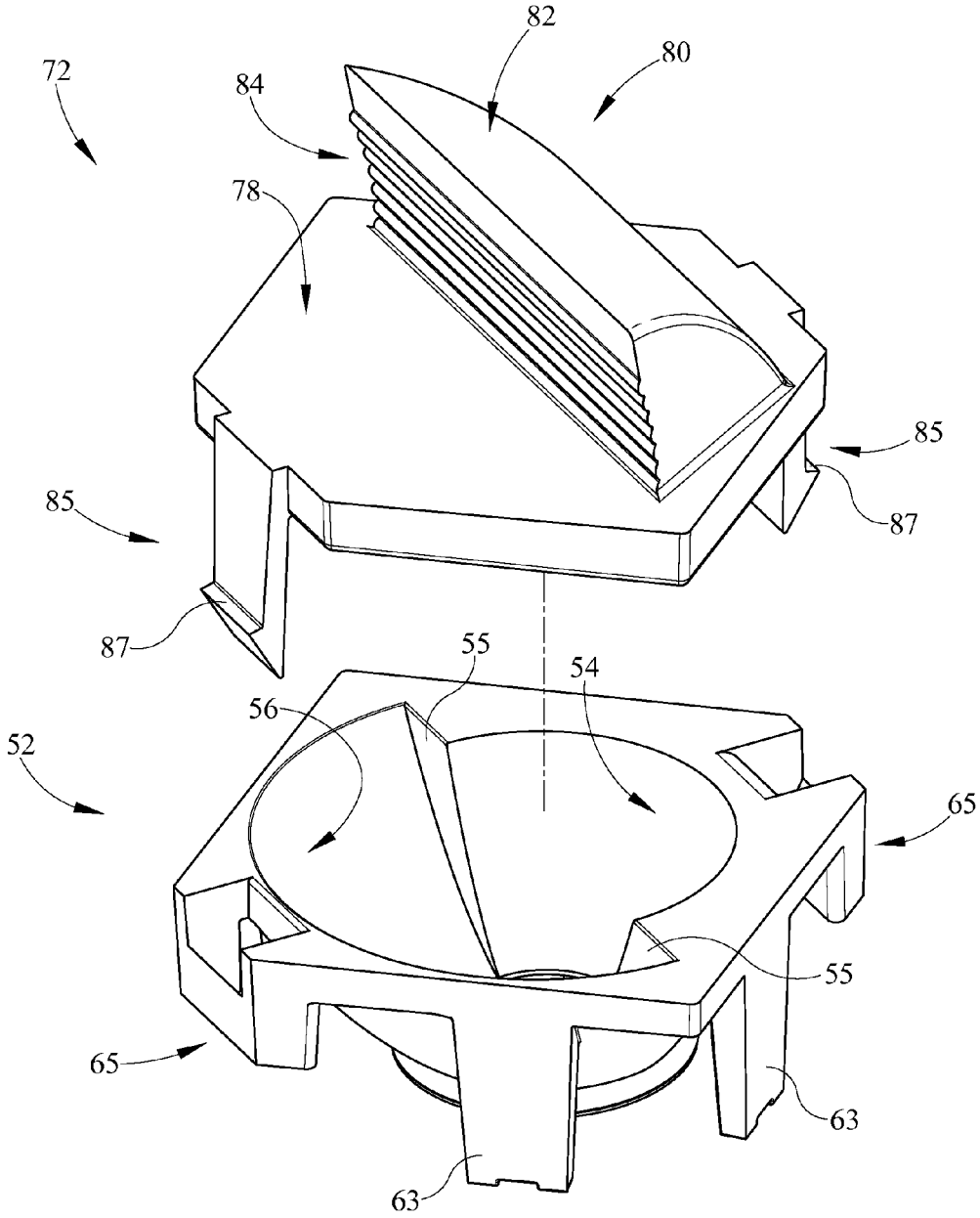
FIG. 2 is a top perspective view of a first embodiment of an optical lens of the LED optical assembly of FIG. 1 exploded away from a reflector of the LED optical assembly of FIG. 1.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

With reference to FIG. 1, a first embodiment of an LED optical assembly 10 has a light emitting diode (LED) assembly or LED circuit board 30, a reflector bank 50, and an optical lens bank 70. The terms "LED" and "light emitting diode" as used herein are meant to be interpreted broadly and can include, but are not limited to, an LED of any color, any luminosity, and any light distribution pattern, and also includes, but is not limited to, an organic light emitting diode (OLED), among others. The embodiment of LED assembly 30 shown has thirty LEDs 34 mounted on LED support surface 32. In some embodiments LEDs 34 may be XLamp XR-E Cool White LEDs from Cree, Inc. In other embodiments LEDs 34 may be XLamp XP-E Cool White LEDs from Cree, Inc. However, any LED configuration may be implemented in the presently described assembly.

In some embodiments of LED support surface 32, LED support surface 32 is a metallic board with advantageous heat distribution properties such as, but not limited to, aluminum. In some embodiments LED support surface 32 is an Aluminum support board from Trilogix Electronic Manufacturing. In other embodiments LED support surface 32 is a flame retardant 4 (FR-4) or other common printed circuit board. LED support surface 32 and plurality of LEDs 34 of LED assembly 30 are merely exemplary of the multitude of boards, number of LEDs, and multitude of LED configurations that may be used. Design considerations such as, but not limited to, heat generation, desired lumen output, and desired light distribution pattern may result in a choice of differing amounts of LEDs, differing LED configurations, and/or differing materials for LED support surface 32.

Reflector bank 50 is shown with thirty individual reflectors 52, each positionable over a single LED 34. Optical lens bank 70 is shown with thirty individual optical lenses 72, which may each be removably coupled over a light output opening of a single reflector 52. Although each LED 34 is shown with a corresponding reflector 52 and a corresponding optical lens 72, in other embodiments of LED optical assembly 10 one or more LEDs 34 may be provided without a corresponding reflector 52 and/or optical lens 72. The number and configuration of reflectors 52 and optical lenses 72 are merely exemplary and may be appropriately adjusted to interact with a differing number or configuration of LED support surfaces 32 and/or LEDs 34.

Figure 3:
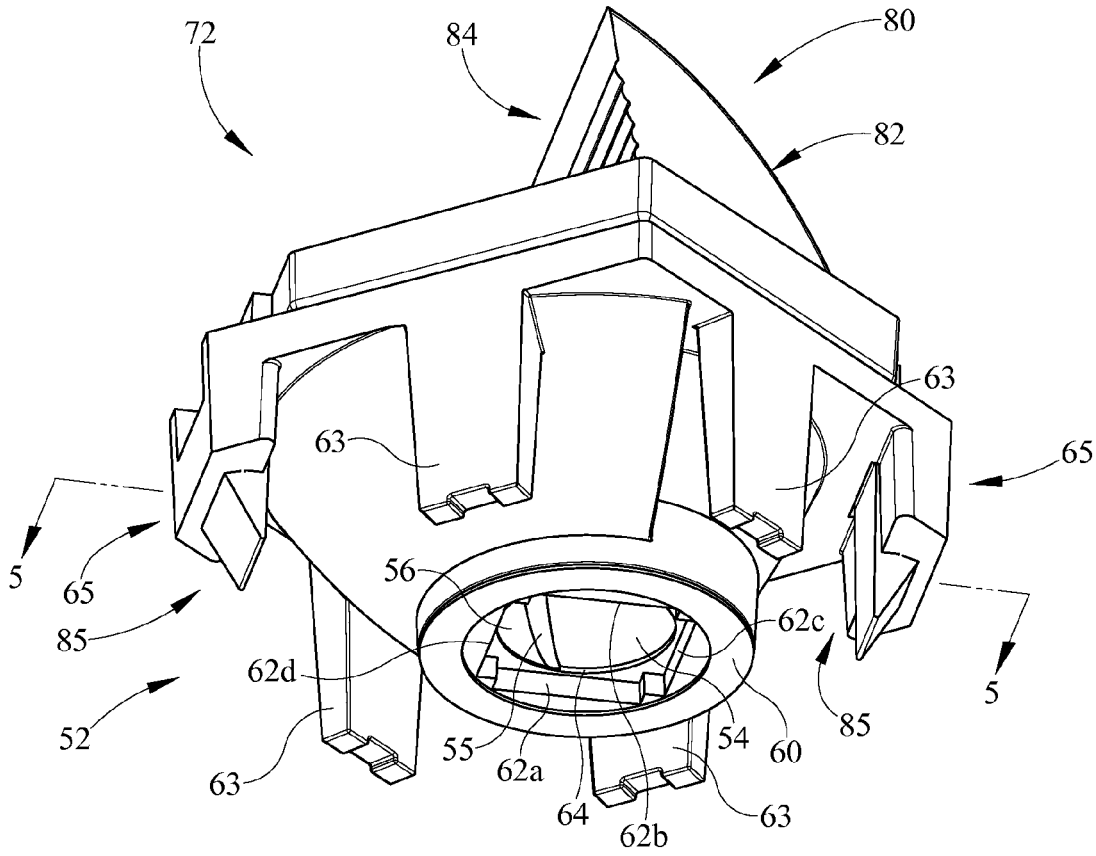
FIG. 3 is a bottom perspective view of the optical lens of FIG. 2 coupled to the reflector of FIG. 2.
Figure 4:
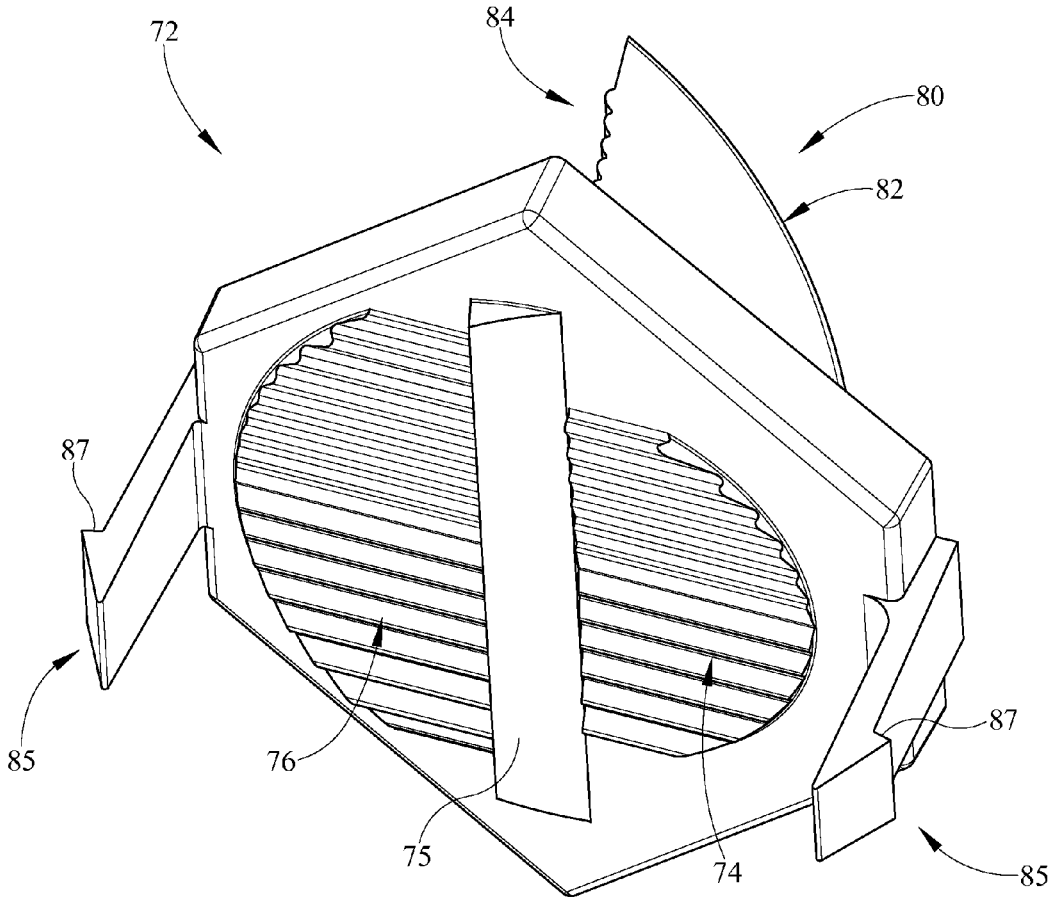
FIG. 4 is a bottom perspective view of the optical lens of FIG. 2.
Figure 5:
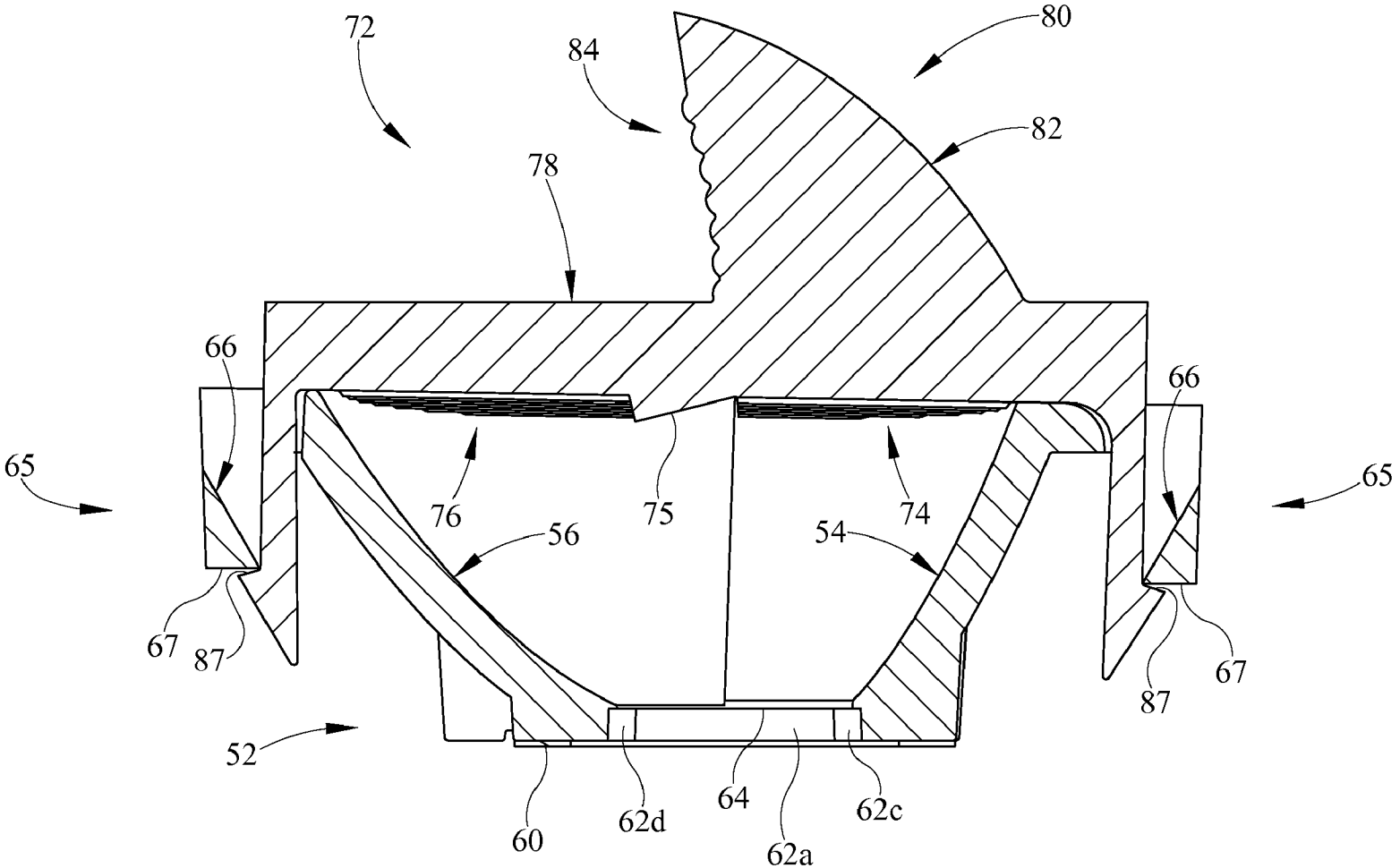
FIG. 5 is a side view, in section, of the optical lens and reflector of FIG. 3 taken along the section line 5-5 of FIG. 3.

With reference to FIG. 2 through FIG. 5, a first embodiment of a single optical lens 72 of FIG. 1 and a single corresponding reflector 52 of FIG. 1 are described in more detail. In the embodiment of FIG. 2 through FIG. 5 optical lens 72 may be removably coupled to reflector 52. Two latches or connection pieces 85 of optical lens 72 removably engage two corresponding latch receptacles or connection areas 65 of reflector 52. Connection pieces 85 in the embodiment of FIG. 2 through FIG. 5 are cantilever latch members with a protrusion 87. With particular reference to FIG. 5, when optical lens 72 is placed over reflector 52, protrusion 87 slides down incline 66 until protrusion 87 reaches the end of incline 66 and engages base 67 of incline 66. Force can be applied against connection piece 85 by a finger, flat head screwdriver, removal tool, or other tool in order to disengage protrusion 87 from base 67 of incline 66 and allow optical lens 72 to be separated from reflector 52.

Connection piece 85 and connection area 65 are merely exemplary of a removable coupling between optical lens 72 and reflector 52. For example, in other embodiments reflector 52 may be provided with a cantilever latch member connection piece and optical lens 72 may be provided with a corresponding latch receptacle connection area. Also, for example, in some embodiments the connection piece may comprise a male protrusion with one or more slots receivable in a connection area that comprises a female receptor with matching pins or slots. A removable coupling between optical lens 72 and reflector 52 allows optical lens 72 to be exchanged for an optical lens having alternative optical characteristics or to allow optical lens 72 to be removed for cleaning or replacement with a clean optical lens. Although removable couplings between optical lens 72 and reflector 52 have been described, in other embodiments optical lens 72 may be non-removably coupled to reflector 52, or optical lens 72 may be provided over reflector 52 without being directly coupled to reflector 52.

With continuing reference to FIG. 2 through FIG. 5, reflector 52 of the depicted embodiment is a dual focal point reflector having a first reflector portion 54 and a second reflector portion 56. Two kick reflectors 55 extend between first reflector portion 54 and second reflector portion 56. In the depicted embodiment first reflector portion 54 is a substantially parabolic reflector having a first focal point and second reflector portion 56 is a substantially parabolic reflector having a second focal point that is distinct from the first focal point of first reflector portion 54. With particular reference to FIG. 5, first reflector portion 54 has a more gradual curvature than second reflector portion 56. In other embodiments first reflector portion 54 and second reflector portion 56 may be non-parabolic and still have distinct curvatures with distinct focal points. Dual focal points enable reflector 52 to appropriately direct light emitted by LEDs 34 having different light distribution characteristics for reasons such as manufacturing tolerances. Dual focal points also enable reflector 52 to appropriately direct light emitted by LEDs having a different design that places the light emitting portion of the LED in a different location within reflector 52. In some embodiments reflector 52 is a reflector produced by GLP Hi-Tech and is made from Lexan 940 A which is then vacuum metalized with Aluminum. In other embodiments reflector 52 may be vacuum metalized with other reflective materials such as, but not limited to, silver and/or gold.

Figure 3A:
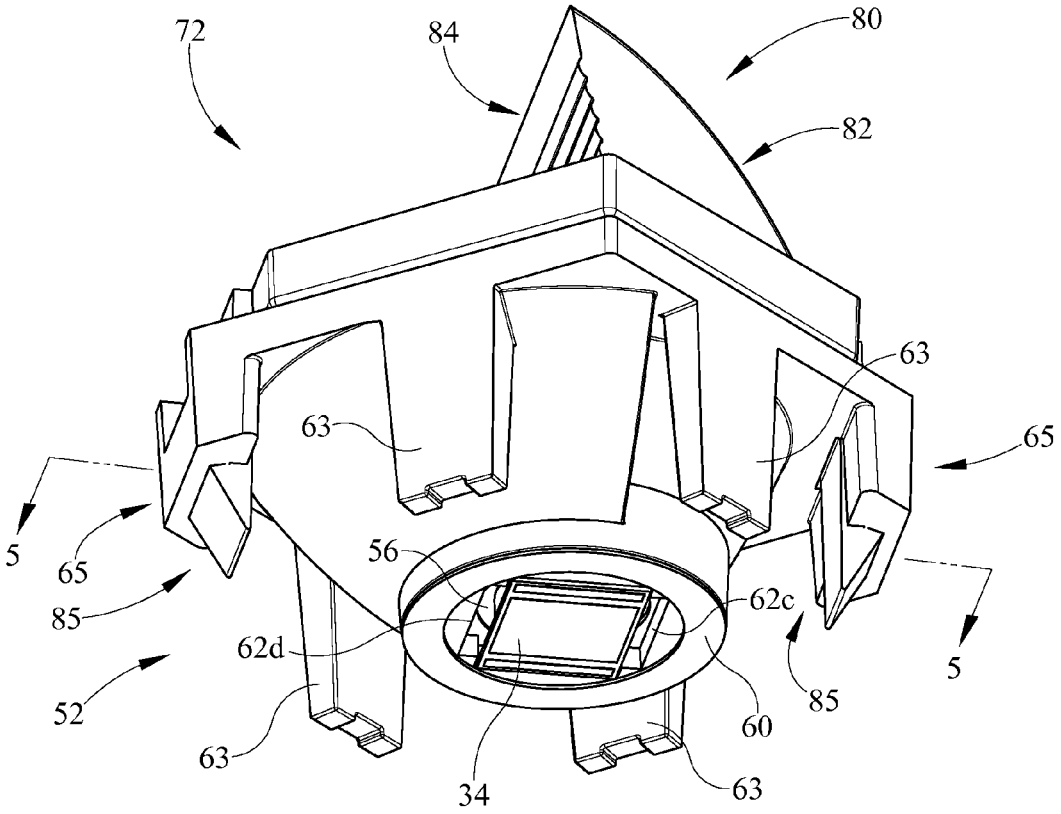
FIG. 3A is a bottom perspective view of the optical lens of FIG. 2 coupled to the reflector of FIG. 2, shown with the reflector positioned about a light emitting diode.

With particular reference to FIG. 3 and FIG. 3A, an LED aperture 64 and a recess portion are sized and shaped so that reflector 52 may be appropriately positioned about a given LED 34. In the depicted embodiment the recess portion and LED aperture 64 are configured so that the LED light output axis of a given LED 34 will be positioned substantially in line with both the first focal point of first reflector portion 54 and the second focal point of second reflector portion 56. In the depicted embodiment aperture 64 is large enough to receive the light emitting portion of LED 34 without contacting LED 34. In the depicted embodiment the recess portion has a generally cruciform shape with arms 62*a*, 62*b*, 62*c*, and 62*d* all of substantially equal dimension. The distance between the tip of arm 62*a* and the tip of arm 62*b* is substantially the same as the distance between the tip of arm 62*c* and the tip of arm 62*d*. The recess portion is shaped and sized to interface with a portion of an outer periphery of an LED that is rectangular, such as, but not limited to, the outer periphery of a single LED 34. In the exemplary embodiment reflector 52 may be placed about a single LED 34 so that the periphery of arms 62*a* and 62*b* contact or are substantially close to portions of the outer periphery of LED 34 and the periphery of arms 62*c* and 62*d* do not contact LED 34, or vice versa. FIG. 3A shows LED 34 in contact with the periphery of arms 62*a* and 62*b*.

It will be appreciated that the recess portion allows reflector 52 to be appropriately aligned about a given LED 34 at any one of four orientations, each approximately ninety degrees apart. It is understood that for appropriate alignment of reflector 52 about an LED 34 it is not necessary that the periphery of arms 62*a* and 62*b* or 62*c* and 62*d* actually contact the outer periphery 34. Rather, a small gap may exist between the outer periphery of LED 34 and the periphery of 62*a* and 62*b* or 62*c* and 62*d* and satisfactory alignment may still be achieved. The recess portion allows for unique orientation of one or more reflectors 52 on LED support surface 32. The recess portion and/or aperture 64 may be adjusted appropriately to accommodate other shapes and sizes of LEDs and to appropriately position other LEDs with respect to reflector 52. For example, in some embodiments the recess portion may be configured to interface with an LED having a square outer periphery, in which case the recess portion may have a substantially square shape.

In other embodiments the recess portion and aperture 64 may be omitted and reflector 52 may be robotically or otherwise positioned about a given LED 34. An adhesive layer 60 is provided exteriorly of recess portion 62 and aperture 64 in some embodiments and may couple reflector 52 to LED support surface 32. Alternative or additional couplings between reflector 52 and LED support surface 32 may be used. In some embodiments reflector 52 may be attached using mechanical affixation methods, including, but not limited to prongs, fasteners, depending structures and the like that interface with corresponding structure on LED support surface 32. Also, this interchangeably includes structure upwardly extending from LED support surface 32 that corresponds with structure on reflector 52. Supports 63 may be provided to help stabilize reflector 52 and in some embodiments may be additionally adhered to LED support surface 32.

In some embodiments first and second reflector portions 54 and 56 and the recess portion of each reflector 52 are configured so that when reflector 52 is placed about a given LED 34, the LED light output axis of the LED 34 will emanate from a point that is between the dual focal points of reflector 52 or equal to one of the dual focal points of reflector 52. The LED light output axis is an axis emanating from approximately the center of the light emitting portion of any given LED 34 and is oriented outward and away from the LED support surface 32. Although two reflector portions 54 and 56 and dual focal points are described herein, other embodiments of reflector 52 may be provided with more than two reflector portions and more than two focal points. For example, in some embodiments three reflectors are provided with three distinct focal points.

With particular reference to FIG. 4 and FIG. 5, the embodiment of optical lens 72 shown has prismatic areas 74 and 76 on a first surface of optical lens 72. Prismatic areas 74 and 76 are separated by refracting bar 75. When optical lens 72 is coupled to reflector 52, prismatic area 74 is provided mainly over reflector portion 54 and aperture 64. Prismatic area 76 is provided mainly over reflector portion 56 and aperture 64. Refracting bar 75 is provided mainly over aperture 64 and portions of reflector 56. In some embodiments refracting bar 75 may be altered or omitted and prismatic areas 74 and 76 may likewise be altered or omitted. Prismatic areas 74 and 76 direct light emanating from LED 34 and contacting prismatic areas 74 and 76 to a wider angle along a horizontal plane, as will be described in more detail herein. Refracting bar 75 directs light emanating from LED 34 and contacting refracting bar 75 in a direction generally away from a face 84 of a cutoff element 80 having a cutoff surface 82. Depending on their angle of incidence, many light rays emanating from LED 34 and contacting cutoff surface 82 are either refracted through cutoff surface 82 in a direction generally toward the light output axis of LED 34 or are reflected off cutoff surface 82 and directed toward and through front face 84. In some embodiments, when optical lens 172 is coupled to reflector 52 and reflector 52 is placed about an LED 34 on LED support surface 32, the distance between LED support surface 32 and non-prismatic areas 174 and 176 is approximately 0.5 inches and the distance between LED support surface 32 and the most distal part of cutoff surface 182 is approximately 1.04 inches.

Figure 6:
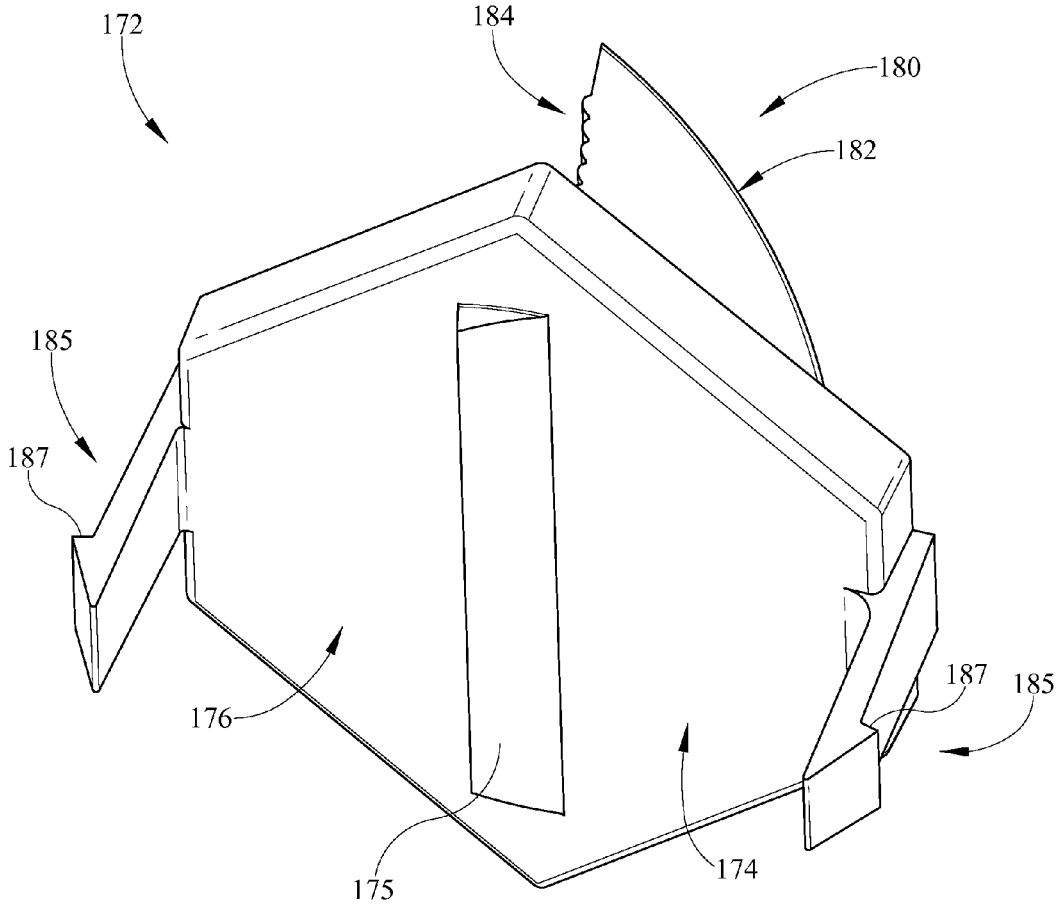
FIG. 6 is a bottom perspective view of a second embodiment of an optical lens of the LED optical assembly of the present invention.
Figure 7:
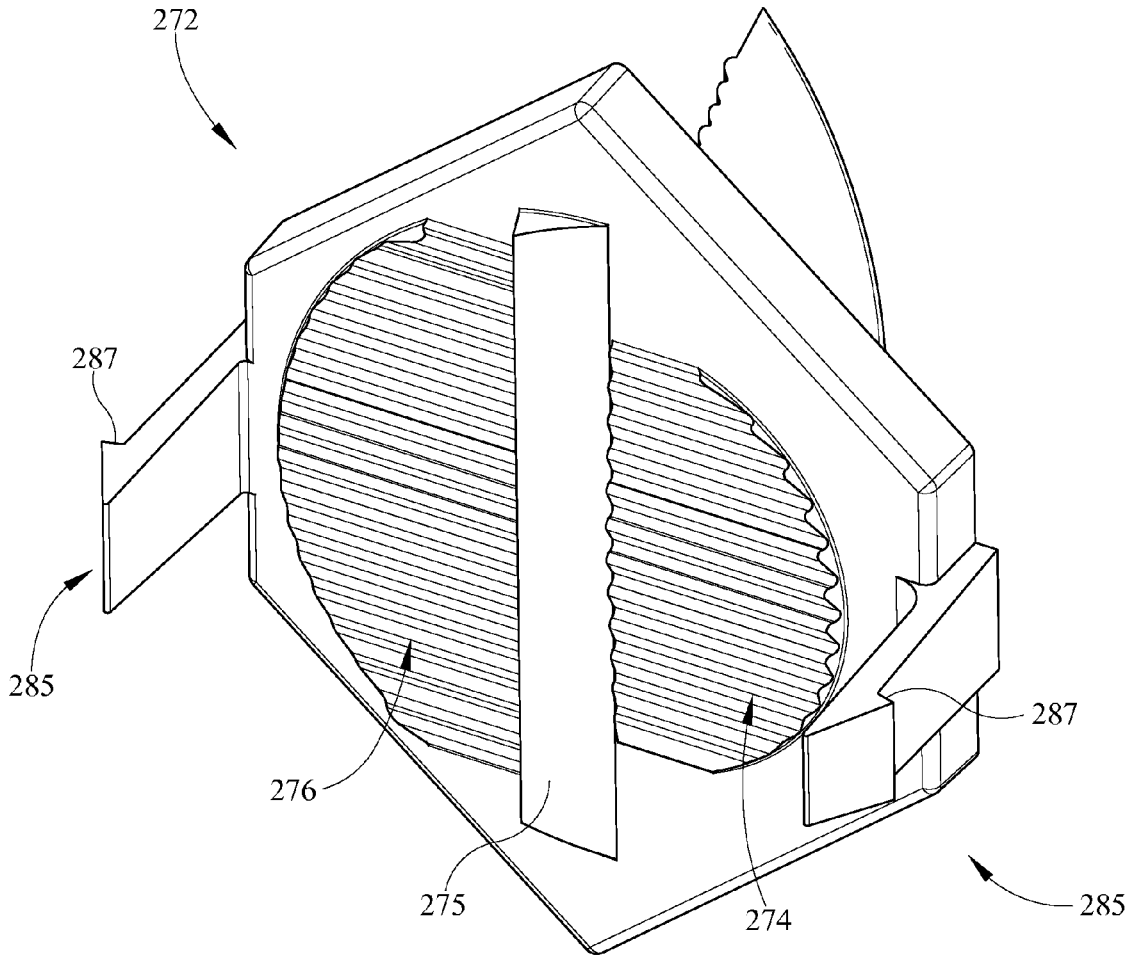
FIG. 7 is a bottom perspective view of a third embodiment of an optical lens of the LED optical assembly of the present invention.

In other embodiments of optical lens, such as optical lens 172 of FIG. 6, refracting bar 175 separates two non-prismatic areas 174 and 176. Non-prismatic areas 174 and 176 do not significantly alter the direction of light emanating from LED 34 and contacting prismatic areas 174 and 176 along a horizontal plane, as will be described in more detail herein. In other embodiments of optical lens, such as optical lens 272 of FIG. 7, refracting bar 275 separates two prismatic areas 274 and 276. Prismatic areas 274 and 276 direct light emanating from LED 34 and contacting prismatic areas 274 and 276 in a first asymmetric direction along a horizontal plane, as will be described in more detail herein. In other embodiments prismatic areas 274 and 276 may be altered to direct light in a second asymmetric direction along a horizontal plane that is substantially opposite the first asymmetric direction, as will be described in more detail herein. In the embodiments of FIG. 6 and FIG. 7, refracting bars 175 and 275 may be altered or omitted. Moreover, in some embodiments one or more of the prismatic areas described may be altered or omitted.

In some embodiments optical lenses 72, 172, and 272 are produced by GLP Hi-Tech and are made from Acrylic V825, having a refractive index of approximately 1.49. Optical lenses 72, 172, and 272 are all configured to be removably coupled to the same reflector 52. As a result, optical lenses 72, 172, and 272 can be selectively coupled to an individual reflector 52 of reflector bank 50 to achieve a desired light distribution. In some embodiments prismatic lenses 272 may be coupled to reflectors 52 on edges of a reflector bank 50 so they may asymmetrically direct light to the edges of an illumination area. In some embodiments prismatic lenses 72 may be coupled to reflectors 52 proximal the edges of a reflector bank 50 to provide a wide dispersion of light proximal to the edges of an illumination area. In some embodiments prismatic lenses 172 may be coupled to reflectors 52 proximal the inner portion of a reflector bank 50 to provide a more narrow dispersion of light near the center of the illumination area. Other arrangements of optical lenses 72, 172, and 272 may be used to achieve desired light distribution characteristics.

Figure 8:
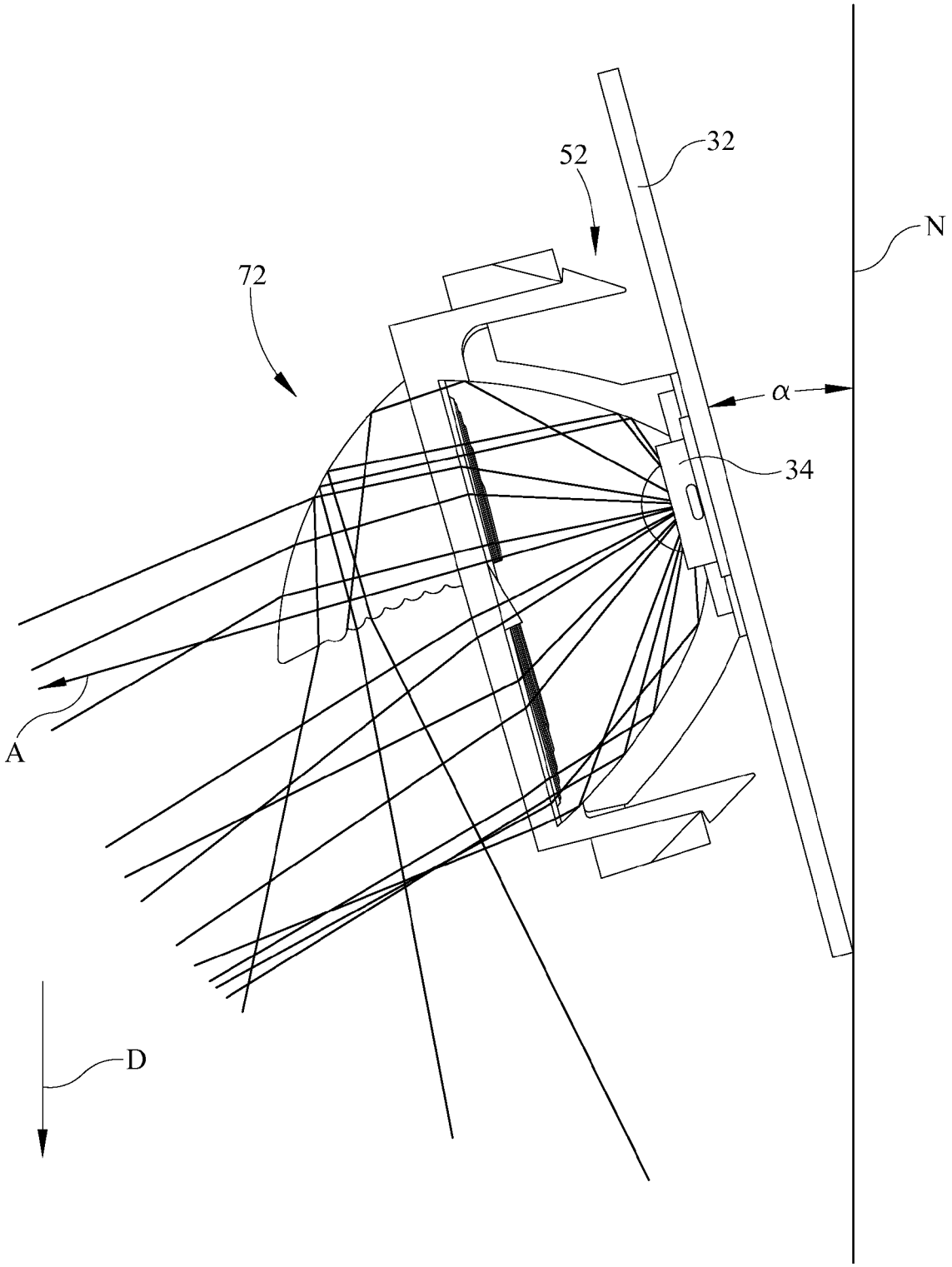
FIG. 8 is a side view of the optical lens and reflector of FIG. 3 taken along the line 5-5 and shown positioned about a LED with a ray trace of exemplary light rays that emanate from the LED.

With reference to FIG. 8, a single reflector 52 is shown about a single LED 34 with a single optical lens 72 placed over reflector 52. Many reference numbers have been omitted in FIG. 8 for simplicity. Reference may be made to FIG. 5 for identification of unlabeled parts in FIG. 8. Ray traces of exemplary light rays that emanate from LED 34 are shown. An LED light output axis is also shown designated by reference letter "A". LED light output axis A is shown for exemplary purposes only, does not represent part of the ray trace, and as a result is not shown as being altered by optical lens 72. LED support surface 32 is shown disposed at an angle, $\alpha$, that is approximately fifteen degrees off a line N. LED light output axis A is directed at approximately a one-hundred-and-five degree angle with respect to line N and approximately a seventy five degree angle with respect to nadir. In some embodiment LED light output axis A may be aimed at approximately a seventy five degree angle with respect to nadir to maintain appropriate cutoff and appropriately direct light downward to an illumination area.

Some light rays emanate from LED 34 and are directed toward first reflector portion 54. Many of those rays originate from a point substantially close to the focal point of first reflector portion 54 and are collimated by reflector 52 and directed toward cutoff surface 82. The rays are incident to cutoff surface 82 at an angle larger than the critical angle and are internally reflected toward and out front face 84. Although front face 84 is shown with ribs, in other embodiments front face 84 may be relatively smooth or otherwise contoured. Other light rays emanate from LED 34 and are directed toward cutoff prism 80 without first contacting first reflector portion 54. Many of those rays are incident to cutoff surface 82 at an angle smaller than the critical angle and are refracted through cutoff surface 82. Some of these same rays may be partially internally reflected toward and out front face 84 as shown. Other light rays emanate from LED 34 and are directed toward refracting bar 75 without first contacting first reflector portion 54 or second reflector portion 56. The light rays are refracted in a direction generally away from front face 84 of cutoff prism 80. Other light rays emanate from LED 34 and are directed toward second reflector portion 56. Those rays are positioned below the focal point of second reflector portion 56 and are reflected by reflector portion 56 in a direction generally away from front face 84 of cutoff prism 80. Those light rays are also refracted in a direction generally away from front face 84 of cutoff prism 80 as they enter optical lens 72 through prismatic area 74 and exit through face portion 78. Yet other light rays emanate from LED 34 and are directed toward prismatic area 74 without first contacting second reflector portion 56 and are refracted in a direction generally away from front face 84 of cutoff prism 80 as they enter optical lens 72 through prismatic area 76 and exit through face portion 78.

The rays presented in FIG. 8 are presented for exemplary purposes. It is understood that other rays may be emitted by LED 34 which may behave differently as they contact reflector 52 and/or optical lens 72. It is also understood that prismatic surfaces 74 and 76 will cause many rays to be directed at a wider angle in a horizontal plane and that this is not depicted in the side view of FIG. 8. With continuing reference to FIG. 8, all the light rays shown exiting optical lens 72 are directed in a direction along, or generally downward and away (as indicated by arrow D) from the light output axis A of LED 34. Although some light rays may exit optical lens 172 and be directed upward and away from the light output axis of LED 34, the light rays will be minimal compared to those directed along and downward and away from the light output axis A of LED 34. It will be appreciated that so long as the LED light output axis A is substantially in line with the focal points of reflector portions 54 and 56 and light rays from LED 34 emanate from a point that is between the dual focal points or equal to one of the dual focal points, a majority of light rays exiting optical lens 172 will be directed along or downward and away (as indicated by arrow D) from the light output axis A of LED 34 and toward an illumination area.

Figure 13A:
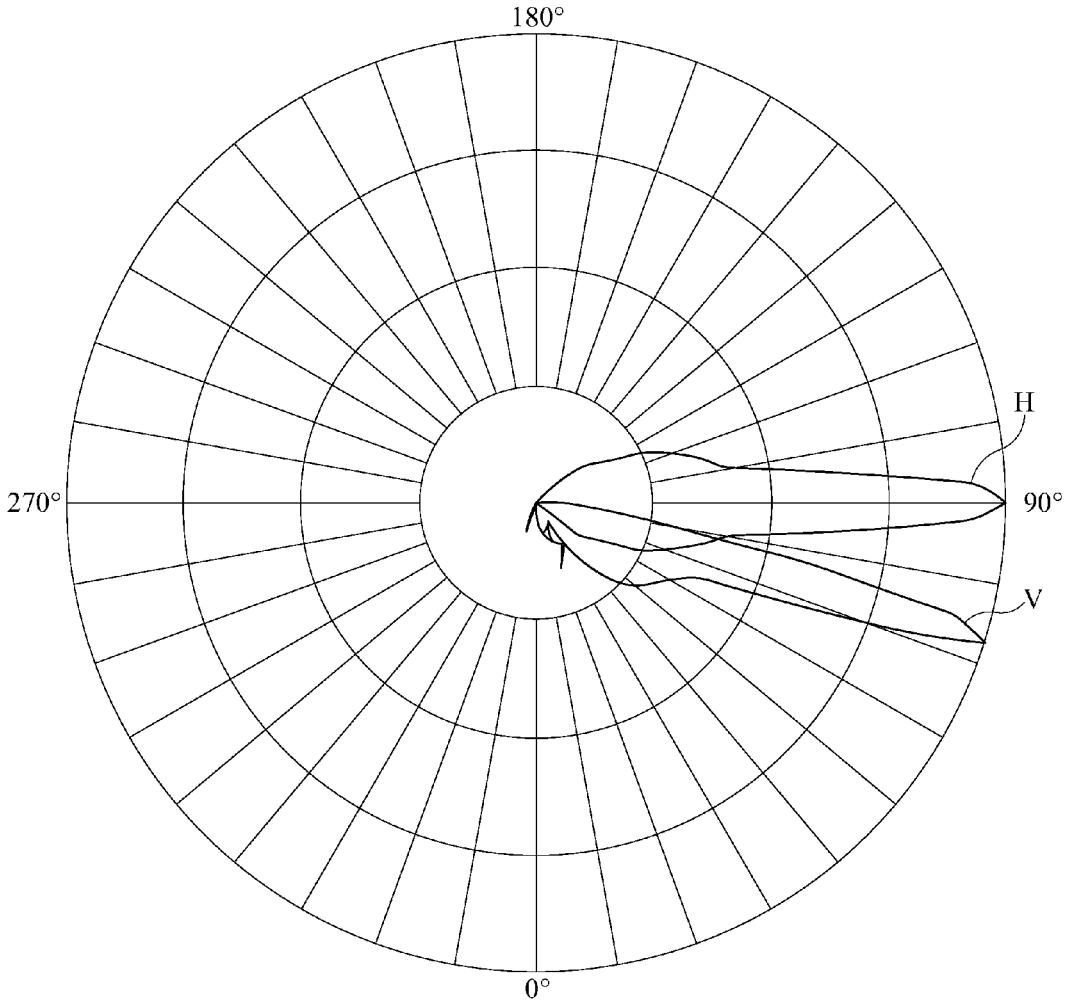
FIG. 13A is a polar distribution, scaled in candela, of a single light emitting diode with its light output axis aimed approximately seventy five degrees off nadir in a vertical direction and with a reflector of FIG. 1 about the light emitting diode and the second embodiment of the optical lens of FIG. 6 coupled to the reflector.
Figure 13B:
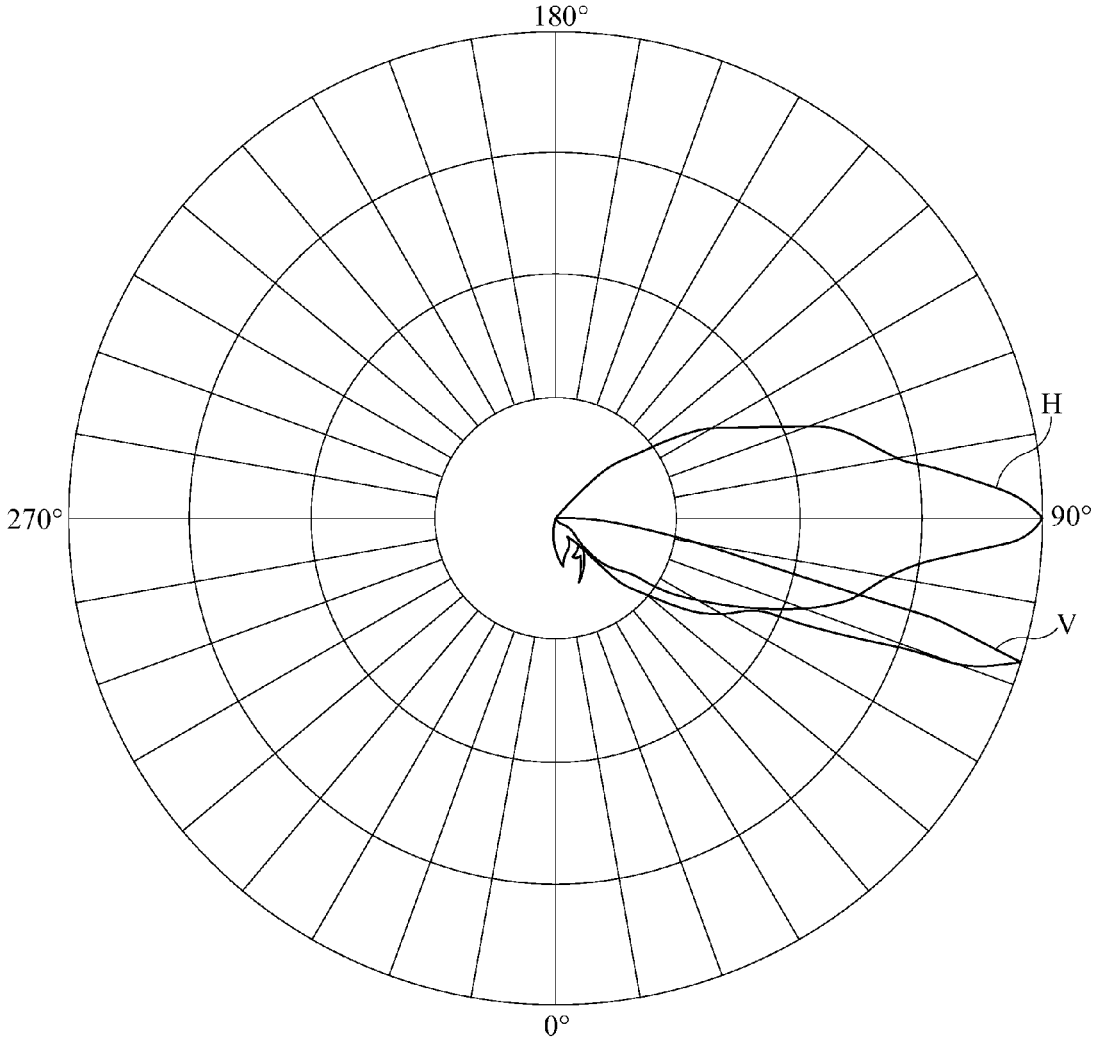
FIG. 13B is a polar distribution, scaled in candela, of a single light emitting diode with its light output axis aimed approximately seventy five degrees off nadir in a vertical direction and with a reflector of FIG. 1 about the light emitting diode and the first embodiment of the optical lens of FIG. 4 coupled to the reflector.
Figure 13C:
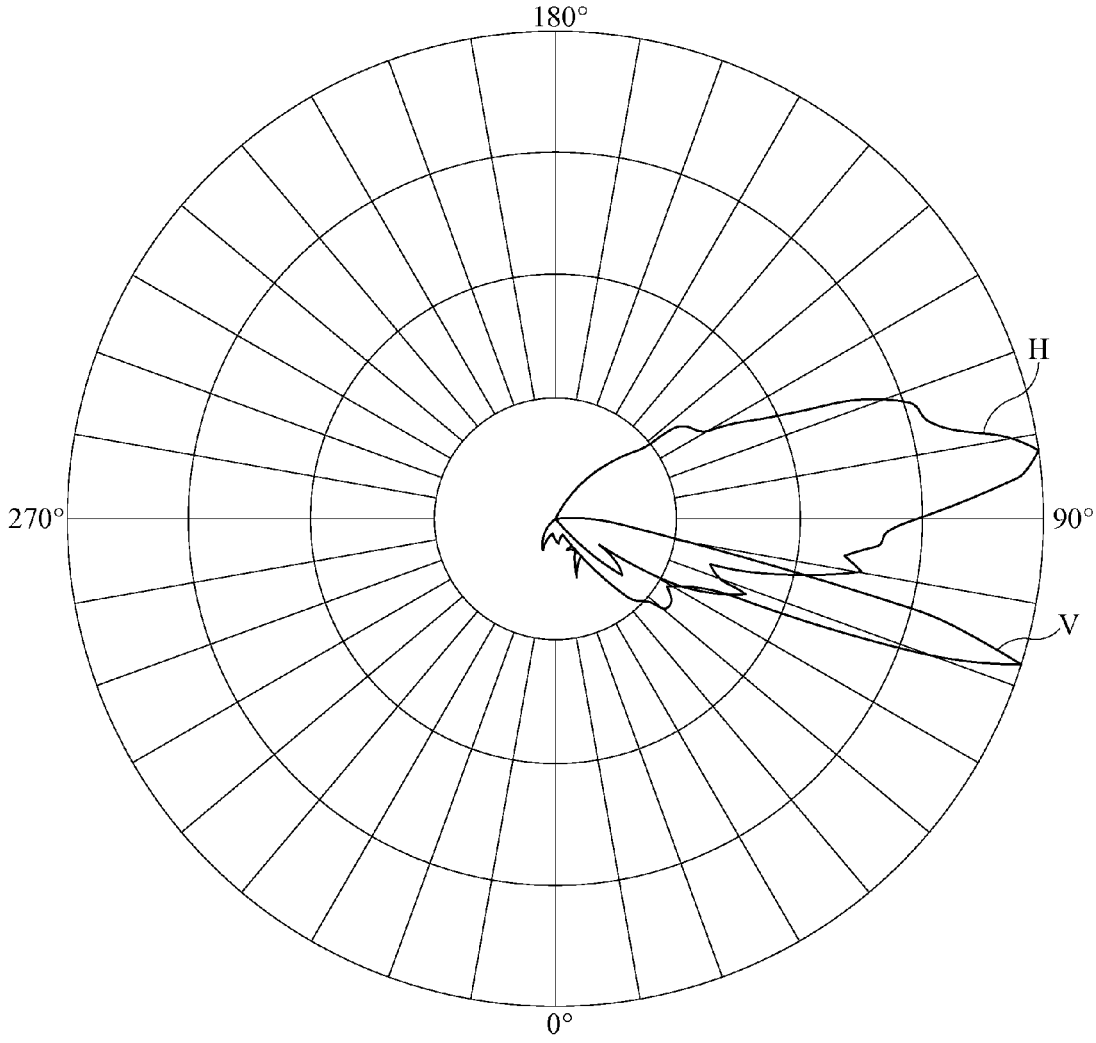
FIG. 13C is a polar distribution, scaled in candela, of a single light emitting diode with its light output axis aimed approximately seventy five degrees off nadir in a vertical direction and with a reflector of FIG. 1 about the light emitting diode and the third embodiment of the optical lens of FIG. 7 coupled to the reflector.

FIG. 13A shows a polar distribution, scaled in candela, of a single LED 34 with its light output axis aimed approximately seventy five degrees off nadir in a vertical direction and with a reflector 52 of FIG. 1 about LED 34 and optical lens 172 of FIG. 6 coupled to reflector 52. FIG. 13B shows a polar distribution, scaled in candela, of a single LED 34 with its light output axis aimed approximately seventy five degrees off nadir in a vertical direction and with a reflector 52 of FIG. 1 about LED 34 and optical lens 72 of FIG. 4 coupled to reflector 52. FIG. 13C shows a polar distribution, scaled in candela, of a single LED 34 with its light output axis aimed approximately seventy five degrees off nadir in a vertical direction and with a reflector 52 of FIG. 1 about LED 34 and optical lens 272 of FIG. 7 coupled to reflector 52.

With reference to FIG. 13A through FIG. 13C, a majority of light outputted by LED 34 in a vertical plane, designated by reference letter "V", is directed along or below the light output axis of LED 34, which is aimed approximately seventy five degrees off nadir in a vertical direction. With reference to FIG. 13A, in which optical lens 172 is used, a majority of light outputted by LED 34 in a horizontal plane, designated by reference letter "H", is directed substantially symmetrically within approximately a fifty degree range. With reference to FIG. 13B, in which optical lens 72 is used, a majority of light outputted by LED 34 in horizontal plane H is directed substantially symmetrically within approximately a seventy-five degree range. The wider range in the horizontal plane is a result of light contacting prismatic areas 174 and 176. With reference to FIG. 13C, in which optical lens 272 is used, a majority of light outputted by LED 34 in horizontal plane H is directed asymmetrically within approximately an eighty degree range. The wider range in the horizontal plane and the asymmetric distribution is a result of light contacting prismatic areas 274 and 276. As described previously, prismatic areas 274 and 276 may be adjusted to asymmetrically distribute light in a substantially opposite direction to that depicted in FIG. 13C. FIG. 13A through FIG. 13C are provided for purposes of illustration only. Of course, other embodiments may be provided that produce differing polar distributions that direct light in a differing range off of and away from the light output axis.

Figure 9:
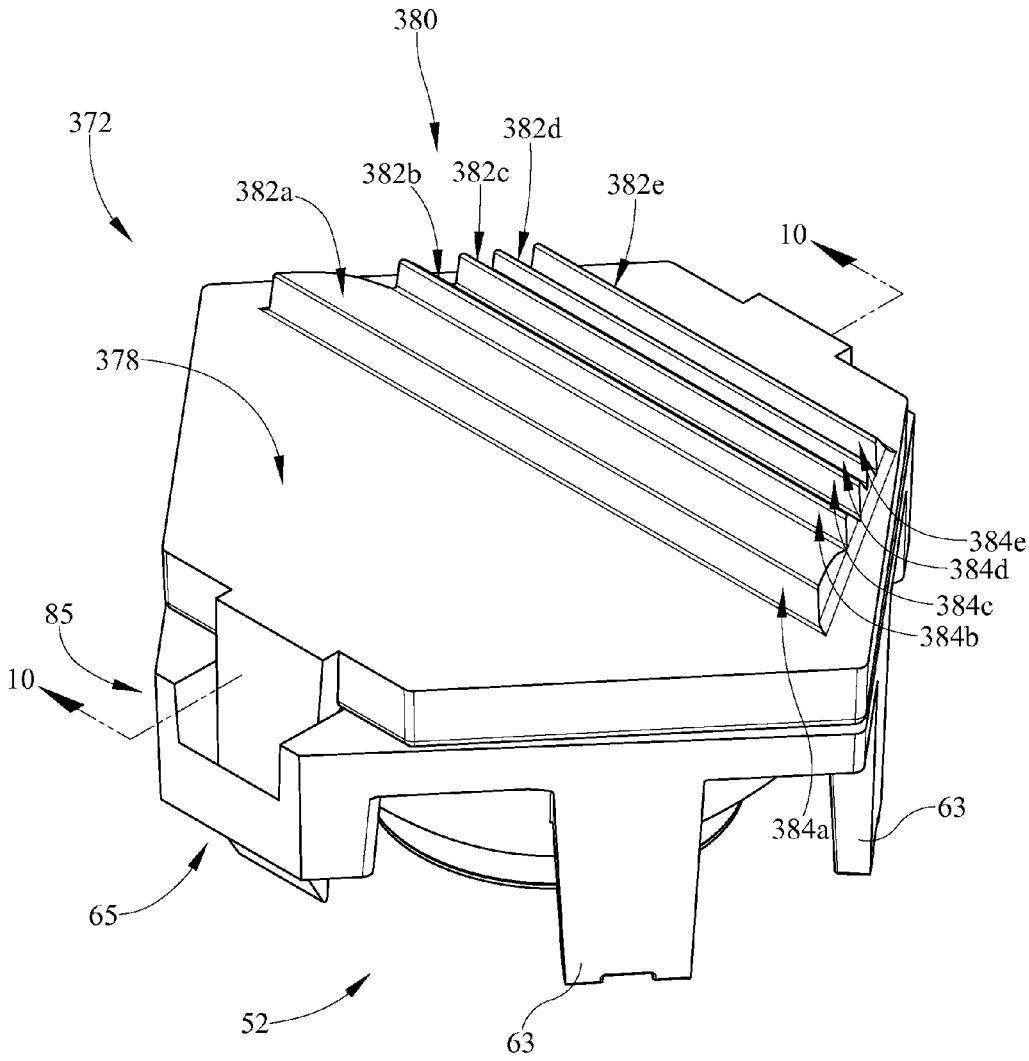
FIG. 9 is a top perspective view of a fourth embodiment of an optical lens of the LED optical assembly of the present invention shown coupled to a reflector of the LED optical assembly of FIG. 1.
Figure 10:
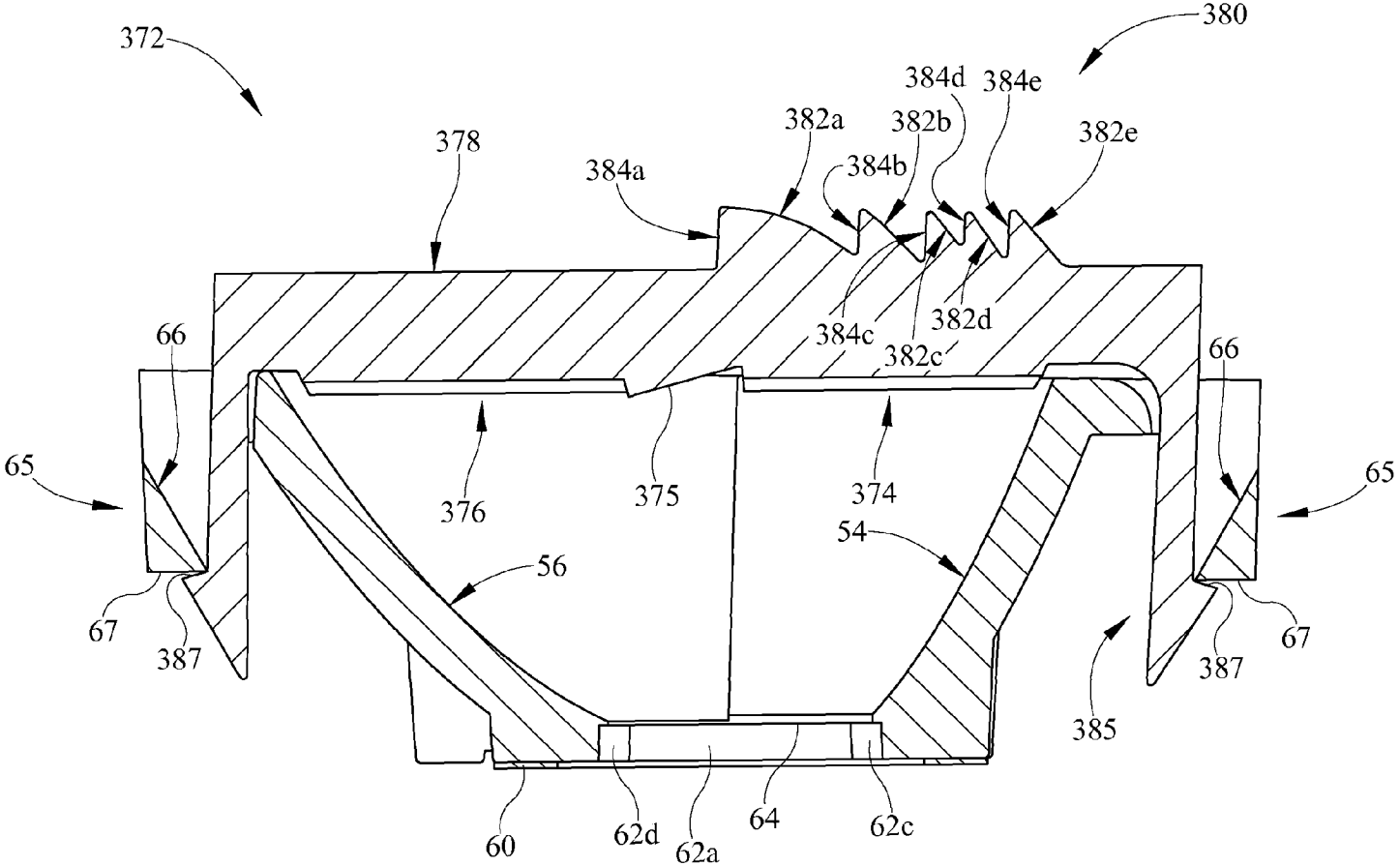
FIG. 10 is a side view, in section, of the optical lens and reflector of FIG. 9 taken along the section line 10-10 of FIG. 9.

With reference to FIG. 9 and FIG. 10, a fourth embodiment of an optical lens 372 is shown coupled to a reflector 52 of the LED optical assembly 10 of FIG. 1. Optical lens 372 has a cutoff prism 380. Cutoff prism 380 has five cutoff surfaces 382*a*, 382*b*, 382*c*, 382*d*, and 382*e* with corresponding front faces 384*a*, 384*b*, 384*c*, 384*d*, and 384*e*. Light rays that emanate from an LED and contact cutoff surfaces 382*a*, 382*b*, 382*c*, 382*d*, or 382*e* are either refracted through the respective cutoff surface 382*a*, 382*b*, 382*c*, 382*d*, or 382*e* in a direction generally toward the corresponding front face 384*a*, 384*b*, 384*c*, 384*d*, or 384*e* or are reflected off the respective cutoff surface 382*a*, 382*b*, 382*c*, 382*d*, or 382*e* and directed toward and through the corresponding front face 384*a*, 384*b*, 384*c*, 384*d*, or 384*e*.

Figure 11:
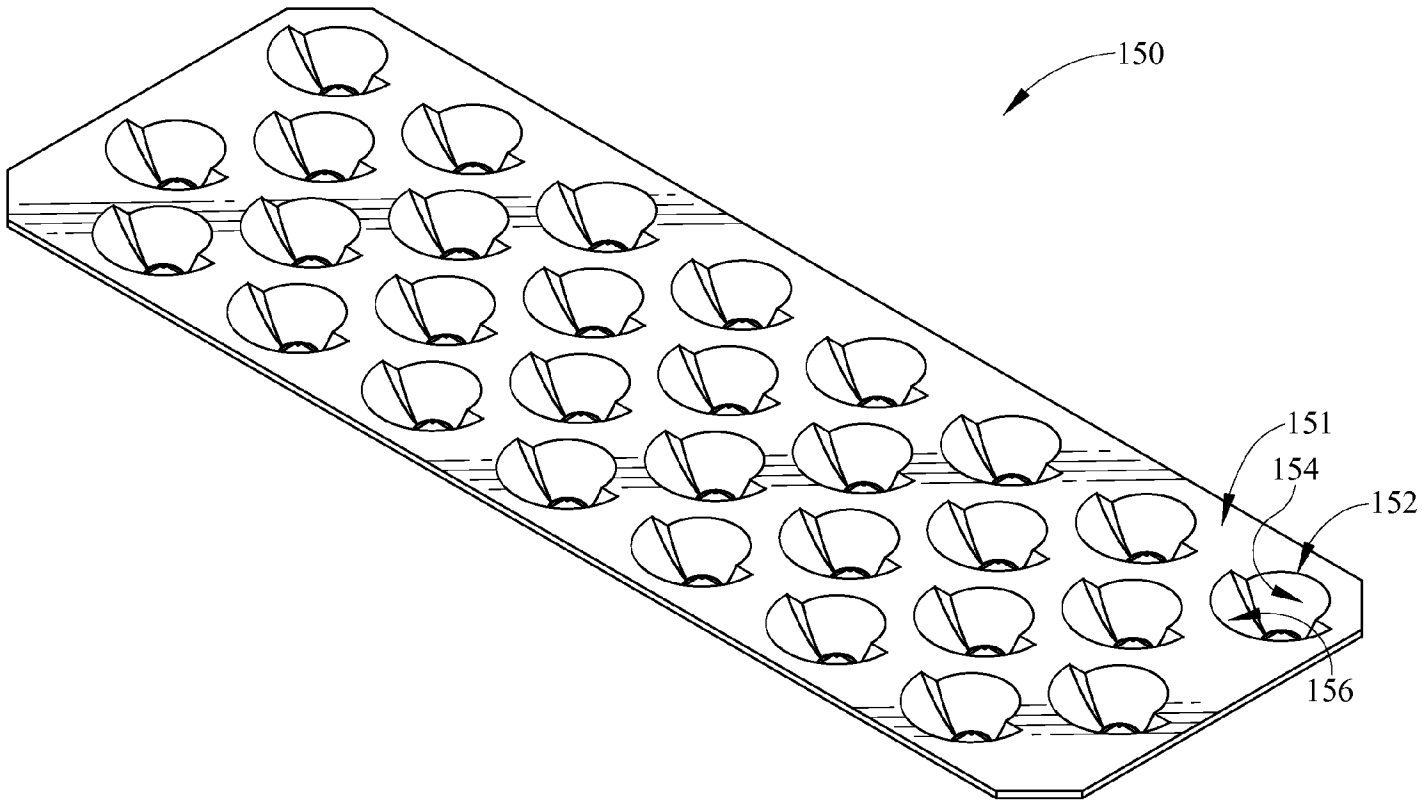
FIG. 11 is a top perspective view of a second embodiment of a reflector bank of the LED optical assembly of the present invention.
Figure 12:
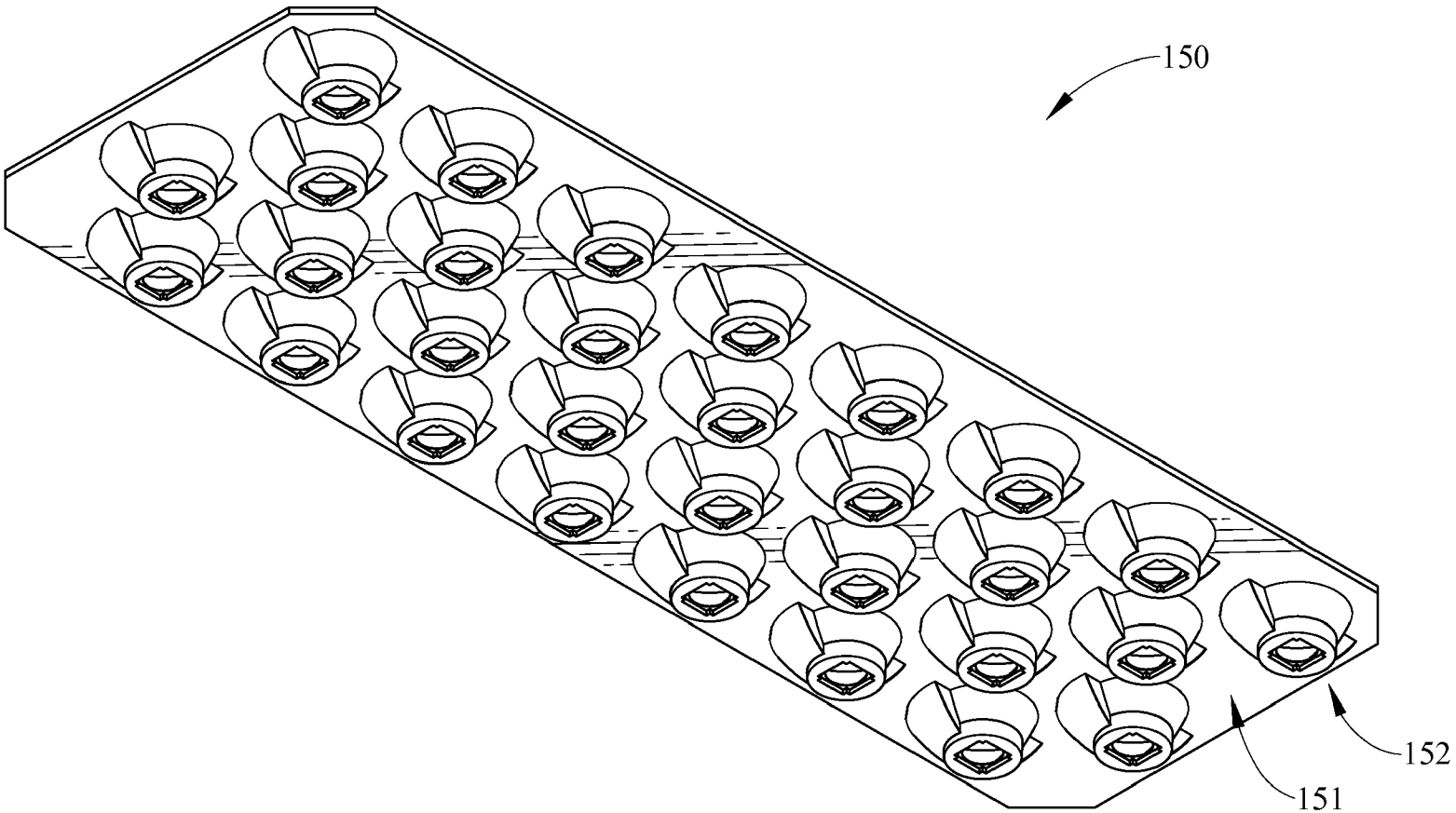
FIG. 12 is a bottom perspective view of the reflector bank of FIG. 11.

With reference to FIG. 11 and FIG. 12, a second embodiment of a reflector bank 150 is shown. Reflector bank 150 is a unitary reflector bank and has thirty individual reflectors 152 with first and second reflector portions 154 and 156. Reflectors 152 are coupled to one another by connecting portion 151. Unitary reflector bank 150 may be coupled to LED assembly 30 of FIG. 1. Optical lenses may be modified to be placed over an appropriate reflector 152. Moreover, in some embodiments optical lenses may be coupled to one another to form a unitary optical lens bank that may be coupled to reflector bank 150. Also, unitary reflector bank 150 could be modified to incorporate connection areas with some or all reflectors 152 for removable coupling of optical lenses to reflectors 152.

Figure 14:
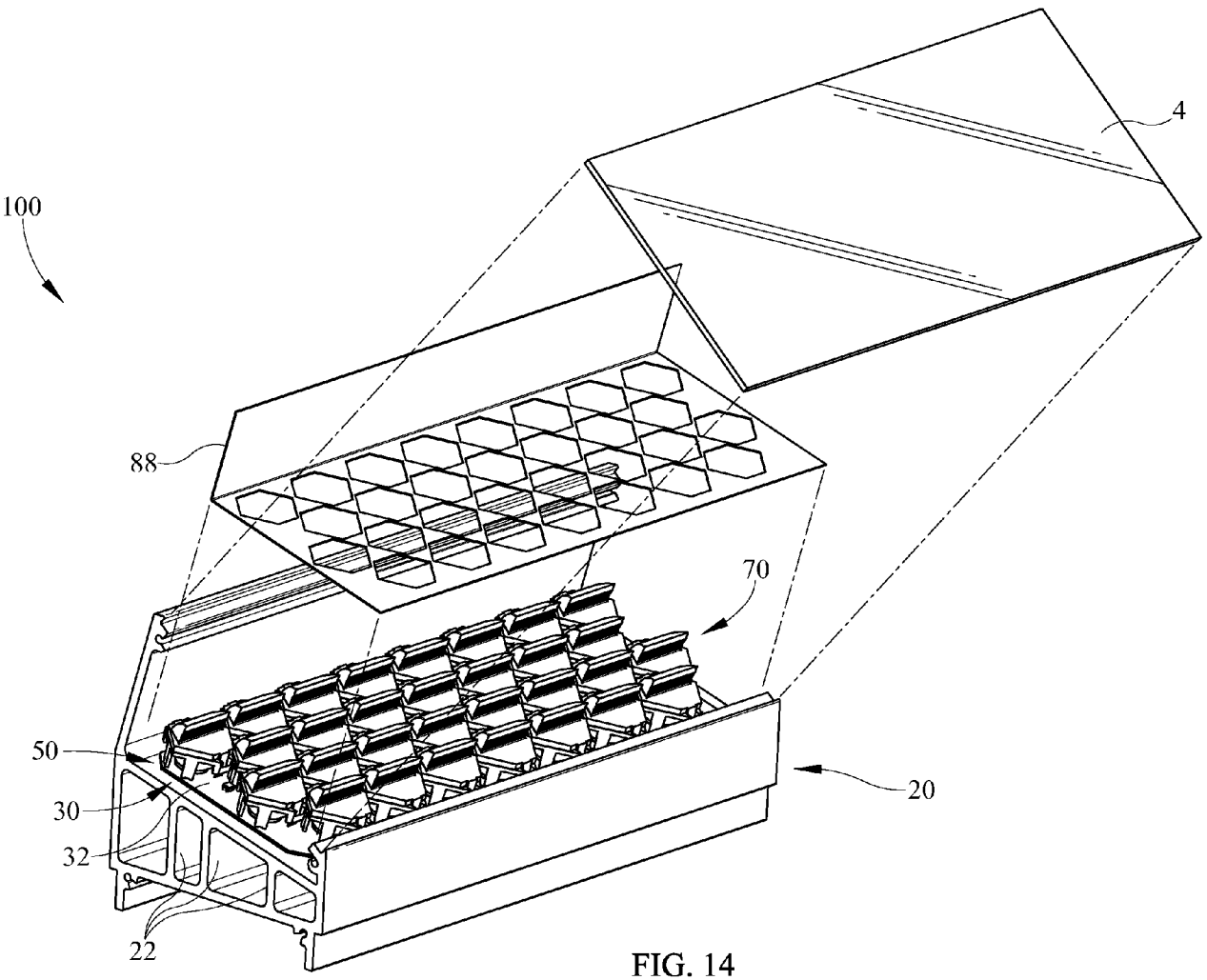
FIG. 14 is a perspective view of a second embodiment of the LED optical assembly of the present invention with a reflector plate and a cover lens exploded away.
Figure 15:
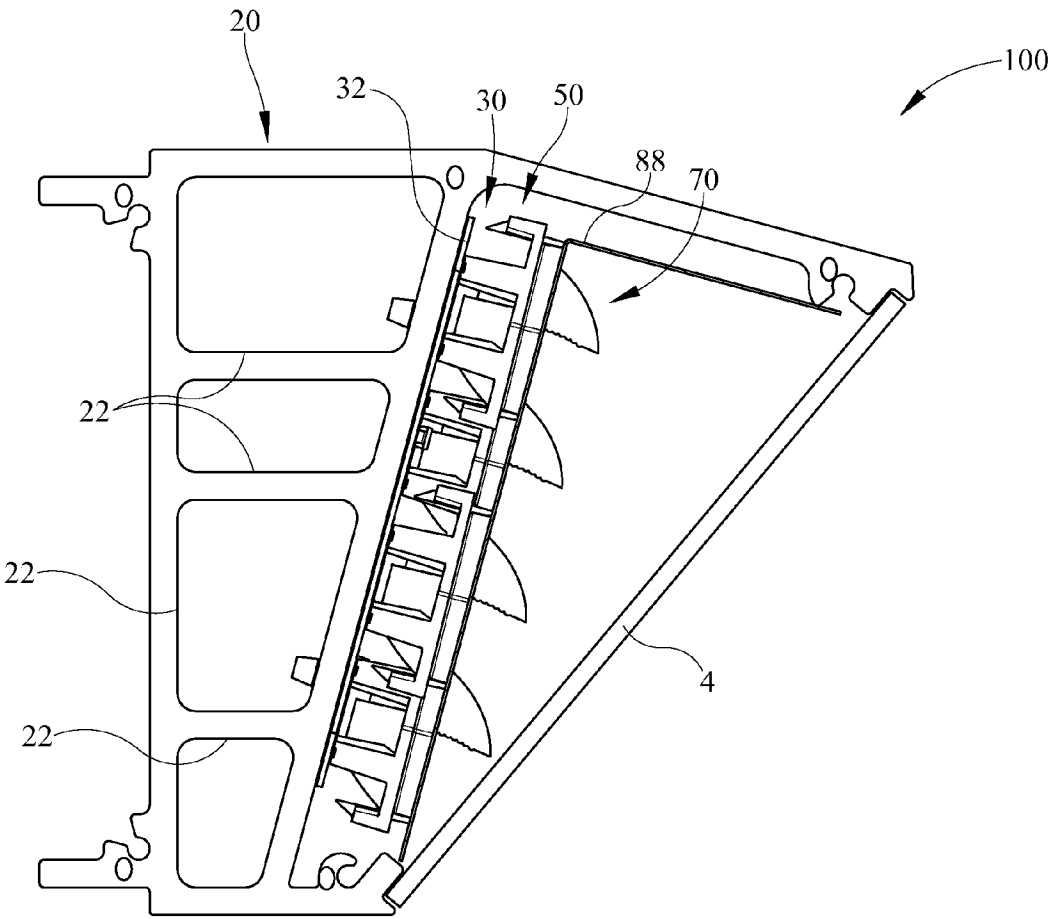
FIG. 15 is a side view of the LED optical assembly of FIG. 14.

With reference to FIG. 14 and 15, a second embodiment of LED optical assembly 100 is shown having a LED assembly 30, a reflector bank 50, and an optical lens bank 70. LED assembly 30 is coupled to heatsink 20 which dissipates heat generated by LED assembly 30. In the depicted embodiment heatsink 20 has channels 22 for airflow and is constructed from aluminum. In other embodiments, alternative heatsink designs and materials may be used or heatsink 20 may be omitted altogether if not needed or desired for heat dissipation. A reflector plate 88 has a portion that extends around optical lenses 72 and a portion that extends generally away from and substantially perpendicular to LED support surface 32. The portion of reflector plate 88 that extends generally away from LED support surface 32 redirects light incident upon it generally toward the area to be illuminated by LED optical assembly 100 and helps maintain an appropriate cutoff Other portions of reflector plate 88 similarly reflect any stray rays generally toward the area to be illuminated by LED optical assembly 100. In some embodiments of LED optical assembly 100 reflector plate 88 may be constructed form aluminum. In some embodiments of LED optical assembly 100 reflector plate 88 may be omitted. A cover lens 4 is also provided and may seal housing and/or alter optical characteristics of light passing there through. In some embodiments of LED optical assembly 100 cover lens 4 may be omitted.

Figure 16:
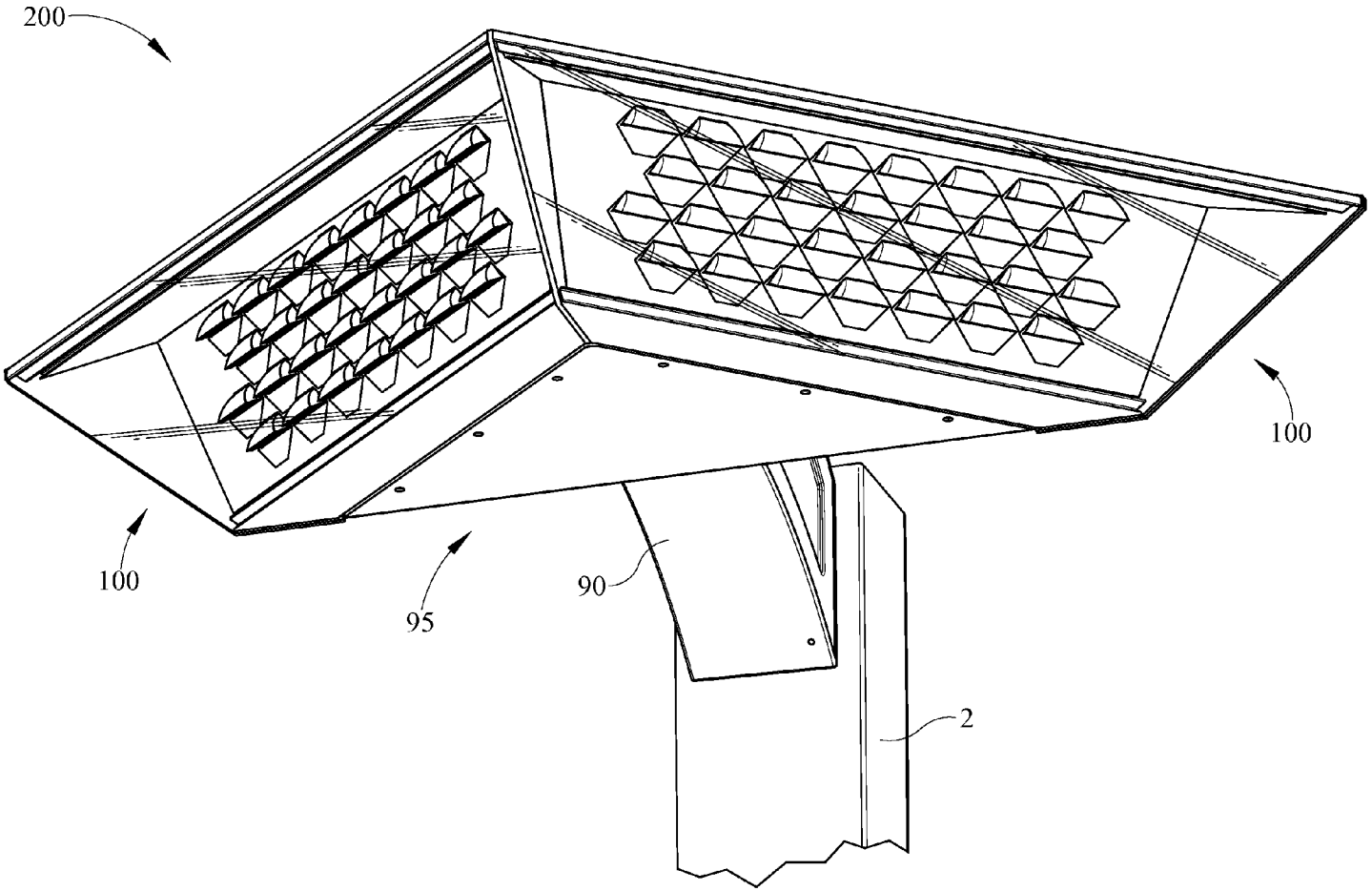
FIG. 16 is a bottom perspective view of a LED luminaire having two of the LED optical assemblies of FIG. 14.
Figure 17:
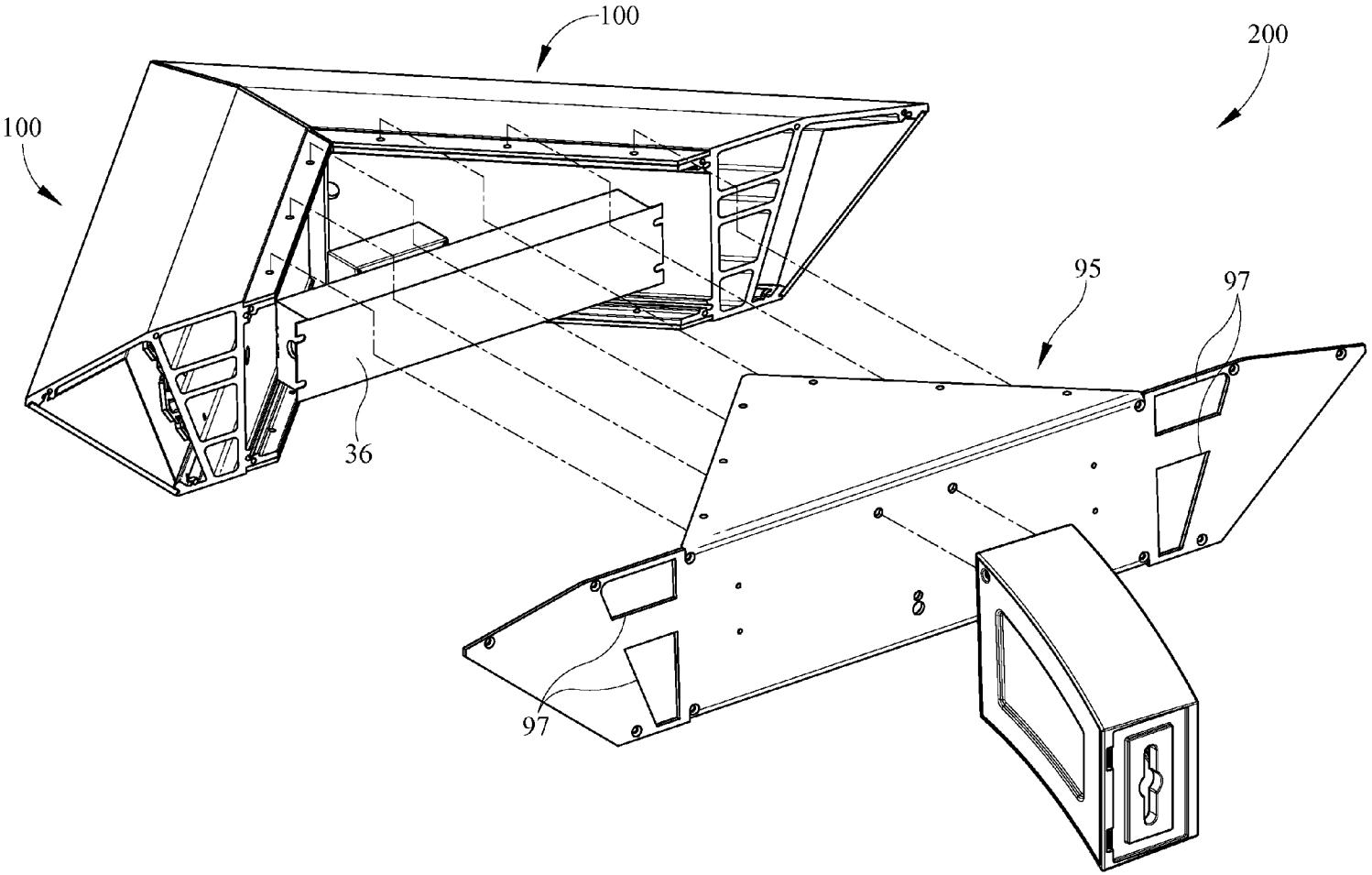
FIG. 17 is a top perspective view of the LED luminaire of FIG. 16, with portions exploded away.

With reference to FIG. 16 and FIG. 17, an LED luminaire 200 has two LED optical assemblies 100 coupled end to end to one another at an angle of approximately ninety degrees. A driver housing 95 encloses an LED driver 36 that provides electrical power to LEDs 34 of LED assembly 30 of each LED optical assembly 100. In some embodiments LED driver 36 is a forty Watt power supply manufactured by Magtech Industries. In other embodiments LED driver 36 is a sixty Watt power supply manufactured by Magtech Industries. In yet other embodiments LED driver 36 is a ninety-six Watt power supply manufactured by Magtech Industries. Driver housing 95 also helps to support LED optical assemblies 100 and connects them through arm mount 90 to a support pole 2. Driver housing 95 has apertures 97 that correspond to channels 22 in heatsink 20 and allow airflow into and out of channels 22. The light output axes of LEDs 34 are directed approximately seventy-five degrees off nadir.

In some embodiments LED luminaire 200 may be configured to achieve Type II or Type III light distribution patterns. Driver housing 95, arm mount 90 and support pole 2 are provided for exemplary purposes only. Also, the number of, orientation of, and configuration of LED optical assemblies 100 are provided for exemplary purposes only. For example, in other embodiments four LED optical assemblies 100 may be placed around a support pole to create Type IV or Type V light distribution patterns. For example, in other embodiments LED optical assemblies 100 may be coupled to a wall or other support surface rather than support pole 2. For example, in other embodiments LED optical assemblies 100 may be coupled directly to support pole 2 and drivers for LEDs 34 may be enclosed within support pole 2. Also, for example, in other embodiments LED optical assemblies 100 may be placed at a different angle with respect to each other and/or light output axes of LEDs 34 may be placed at different angles with respect to nadir.

The foregoing description has been presented for purposes of illustration. It is not intended to be exhaustive or to limit the invention to the precise forms disclosed, and obviously many modifications and variations are possible in light of the above teaching. It is understood that while certain forms of the LED optical assembly have been illustrated and described, it is not limited thereto except insofar as such limitations are included in the following claims and allowable functional equivalents thereof.

We claim:

1. An LED optical assembly comprising:

a support surface having a plurality of light emitting diodes;

a plurality of reflectors forming a reflector bank and mounted on said support surface, each of said plurality of reflectors positioned over one of said plurality of light emitting diodes;

a plurality of optical lenses forming an optical lens bank, said optical lens bank removably coupled to and positioned over said reflector bank such that each of said plurality of optical lenses is positioned over one of said plurality of reflectors, and wherein a cutoff prism extends from at least one of said plurality of optical lenses in a direction outward and away from said support surface.

2. An LED optical assembly comprising:

a support surface having a plurality of light emitting diodes;

a plurality of reflectors forming a reflector bank and mounted on said support surface, each of said plurality of reflectors positioned over one of said plurality of light emitting diodes;

a plurality of optical lenses forming an optical lens bank, said optical lens bank removably coupled to and positioned over said reflector bank such that each of said plurality of optical lenses is positioned over one of said plurality of reflectors, and wherein a cutoff prism extends from at least one of said plurality of optical lenses in a direction outward and away from said support surface;

wherein at least one of said plurality of reflectors has a first reflector portion having a first focal point and a second reflector portion having a second focal point, said first focal point being located closer to said support surface than said second focal point.

3. The LED optical assembly of claim 2, wherein said plurality of reflectors forming said reflector bank are coupled to one another to form a unitary reflector bank.

4. The LED optical assembly of claim 2, wherein each said first reflector portion extends approximately one hundred and eighty degrees about one of said plurality of light emitting diodes.

5. The LED optical assembly of claim 4, wherein each said second reflector portion extends approximately one hundred and eighty degrees about one of said plurality of light emitting diodes.

6. The LED optical assembly of claim 5, wherein a kick reflector extends between each junction of each said first reflector portion and each said second reflector portion.

7. The LED optical assembly of claim 2, wherein a prismatic area is provided on at least a portion of a first surface of at least one of said plurality of optical lenses, each said first surface covering a light output opening of one of said plurality of reflectors and generally facing one of said plurality of reflectors.

8. The LED optical assembly of claim 7, wherein an outer periphery of a base of each of said light emitting diodes is received in a corresponding recess portion of each of said plurality of reflectors, each said recess portion shaped to be immediately adjacent at least portions of said outer periphery of each of said light emitting diodes.

9. The LED optical assembly of claim 8, wherein each said recess portion has a generally cruciform shape and each said outer periphery of said base of each of said light emitting diodes has a generally rectangular shape.

10. The LED optical assembly of claim 7, wherein said plurality of optical lenses forming said optical lens bank are separate from one another and form a non-unitary optical lens bank.

11. The LED optical assembly of claim 10, wherein at least one of said plurality of optical lenses has at least one cantilever latch extending therefrom.

12. The LED optical assembly of claim 11, wherein at least one of said plurality of reflectors has a cantilever latch receptacle removably receiving said at least one cantilever latch from said at least one of said optical lenses.

13. An LED optical assembly comprising:

a support surface having a plurality of light emitting diodes, each of said plurality of light emitting diodes having a light output axis oriented outward and away from said support surface;

a plurality of reflectors adjacent said support surface, each of said plurality of reflectors positioned over one of said light emitting diodes and being a bi-focal reflector with a first reflector portion having a first curvature and a second reflector portion having a second curvature, said first curvature being more gradual than said second curvature;

a plurality of optical lenses, at least one of said plurality of optical lenses being positioned over one of said reflectors, and at least one of said plurality of optical lenses having at least one cutoff prism extending from a portion thereof, each said cutoff prism extending in a direction outward and away from said support surface.

14. The LED optical assembly of claim 13, wherein each said cutoff prism is positioned over at least a portion of one said first reflector portion and at least a portion of one of said plurality of light emitting diodes.

15. The LED optical assembly of claim 14, wherein said first reflector portion and said second reflector portion are each substantially parabolic.

16. The LED optical assembly of claim 14, wherein each said first reflector portion has a first focal point on said light output axis and each said second reflector portion has a second focal point on said light output axis, each said first focal point being located more proximal said support surface than each said second focal point.

17. The LED optical assembly of claim 14, wherein a prismatic area having a plurality of prisms is provided on at least a portion of a first surface of at least one of said plurality of optical lenses, each said first surface covering a light output opening of one of said plurality of reflectors and generally facing one of said plurality of reflectors.

18. The LED optical assembly of claim 17, wherein each said cutoff prism has a curved cutoff surface, each said cutoff surface extending upward and away from said support surface.

19. The LED optical assembly of claim 17, wherein at least one of said prismatic areas redirects light asymmetrically.

20. The LED optical assembly of claim 18, wherein each said prismatic area is positioned over at least a portion of one said second reflector portion and at least a portion of one of said plurality of light emitting diodes.

21. The LED optical assembly of claim 17, wherein a refracting bar is provided on said first surface of at least one of said plurality of optical lenses, said refracting bar extending from proximal a first junction of said first reflector and said second reflector to proximal a second junction of said first reflector and said second reflector.

22. The LED optical assembly of claim 14, wherein at least one of said plurality of optical lenses has a plurality of cutoff prisms extending from a portion thereof, each of said plurality of cutoff prisms extending in a direction outward and away from said support surface.

23. The LED optical assembly of claim 13, wherein at least one of said plurality of optical lenses has at least one cantilever latch member extending therefrom and wherein at least one of said plurality of reflectors has at least one cantilever latch connection area, said at least one cantilever latch connection area removably receiving said at least one cantilever latch member.

24. An LED optical assembly comprising:

a support surface having a plurality of light emitting diodes mounted thereon;

a plurality of reflectors affixed together to form a reflector bank, said reflector bank mountable on said support surface such that each reflector is aligned over a single of said plurality of light emitting diodes;

a plurality of optical lenses forming a lens bank, said lens bank affixed to said reflector bank such that at least one of said plurality of optical lenses is mounted over at least one of said plurality of reflectors;

wherein each of said plurality of reflectors is a bi-focal reflector with a first reflector portion and a second reflector portion, said first reflector portion having a first curvature and said second reflector portion having a second curvature, said first curvature being more gradual than said second curvature.

25. The LED optical assembly of claim 24, wherein each of said optical lenses has a cutoff prism with a curved cutoff surface, each said cutoff prism extending upwardly and away from said support surface.

26. The LED optical assembly of claim 25, wherein each of said plurality of optical lenses has a refracting bar adjacent said reflector.

27. The LED optical assembly of claim 26, wherein each of said optical lenses has a prismatic area on a first surface thereof, each said first surface covering a light output opening of one of said plurality of reflectors and generally facing one of said plurality of reflectors.

* * * * *